US005082130A

United States Patent [19]

Weinstein

[11] Patent Number: 5,082,130

[45] Date of Patent: Jan. 21, 1992

[54] TWIST TUBE LIFT CHILD PROOF CAP AND CONTAINER

[75] Inventor: Jack Weinstein, Manchester Township, Ocean County, N.J.

[73] Assignee: Primary Delivery Systems, Inc., Easton, Pa.

[21] Appl. No.: 552,470

[22] Filed: Jul. 17, 1990

[51] Int. Cl.[5] ..... B65D 50/04

[52] U.S. Cl. ..... 215/225; 215/230; 215/203; 215/219

[58] Field of Search ..... 215/203, 206, 208, 211, 215/213, 224, 225, 230, 235, 243, 219

[56] References Cited

U.S. PATENT DOCUMENTS

| | | | |
|---|---|---|---|
| 2,392,507 | 1/1946 | Sebell | 215/235 |
| 3,528,581 | 9/1970 | Lange, Jr. | 215/213 |
| 3,603,470 | 9/1971 | Armour | 215/213 |
| 3,656,645 | 4/1972 | Fontenelli | 215/225 |
| 4,121,727 | 10/1978 | Robbins et al. | 215/211 |
| 4,207,982 | 6/1980 | Maxwell et al. | 215/230 X |
| 4,449,638 | 5/1984 | Davis | 215/211 |
| 4,619,370 | 10/1986 | Agbay et al. | 215/225 |
| 4,730,745 | 3/1988 | Perry | 215/230 |
| 4,763,801 | 8/1988 | Nycz | 215/203 |
| 4,941,580 | 7/1990 | Julian | 215/225 X |

*Primary Examiner*—Stephen Marcus
*Assistant Examiner*—Vanessa Caretto
*Attorney, Agent, or Firm*—Kenneth P. Glynn

[57] ABSTRACT

The present invention is directed to a child resistance container and lid which utilizes a semi-flexible ring. The snap lid which is utilized in the present invention container is substantially set into the top of the container and this lid has one component of either an extended lift member or an indented lift guide. The ring has the other component of either the extended lift member or the indented lift guide. When the ring is rotated, the snap lid cannot be opened. The snap lid can only be opened when the ring is simultaneously squeezed and rotated. In an alternative embodiment, the two component lift system is utilized wherein both components extend outwardly rather than one extending outwardly and one indented. They have geometric configurations so that one first slides past the other and then, in their reverse motion, one lifts the other so as to lift up a lid during operation.

7 Claims, 4 Drawing Sheets

TWIST TUBE LIFT CHILD PROOF CAP AND CONTAINER

BACKGROUND OF THE INVENTION

1. Field of the Invention

The present invention is directed to child resistant containers and lids and more specifically, child resistant containers having lids which are flip cap type lids. The present invention involves such container and lid systems which require compound movement for opening, e.g., simultaneous squeeze and twist, or squeeze, twist clockwise and twist counterclockwise or the like. These may include indicator displays that count the number of openings which occur.

2. Prior Art Statement

Prior art patents describe many hundreds of types of child resistant caps and these have developed over the past twenty years or so. For example, U.S. Pat. No. 3,451,576, issued in 1969 to Norman Lewis describes a locking closure with a false release for toxic containers to prevent children from opening these. Other types of systems have evolved, including the tamper evident and combination tamper evident, child resistant closures. For example, U.S. Pat. Nos. 4,595,123 and 4,669,620 describe closures which require the removal of a flange or other portion in order to be opened and this acts as an indication of whether or not the container has been tampered with.

More significant prior art has developed which requires downward pressure coupled with some other action in order to open a cap and this complex motion requirement typically renders a closure substantially child proof or child resistant. U.S. Pat. No. 3,685,676 to Gach and Leonard, describes a child proof screw cap which has a deformable top which requires substantial pressing in order to effect opening. The deformation is designed so that a one way drive ratchet can only be operated when the cap is deformed and this outer shell deformation requires strength which is beyond the strength of a small child. Likewise, U.S. Pat. No. 4,364,484 issued to John Kinsley, requires downward force coupled with interlocking mechanisms in order to open a closure. U.S. Pat. No. 4,605,135 also describes a container which requires downward force as well as rotation in order to effect the opening of the closure.

While the above patents describe systems which require downward pressure, a series of patents have been issued which describe closures characterized in general as safety closures or child resistant closures which require some squeezing or inward side pressure on the cap or closure in order to effect opening. Thus, U.S. Pat. No. 3,926,328 issued to David Cistone shows a ratcheted outer cap which can only be engaged with an inner cap by squeezing of the outer cap and turning. U.S. Pat. No. 4,513,888 to John J. Curry describes a dispensing cap with an integral spring hinge for a snap lid. The dispensing cap includes a child resistance mechanism which requires a certain amount of inward pressure to be applied to a portion of the cap in order to expose an under portion of the cap to enable completion of the opening thereof.

U.S. Pat. No. 4,789,057 to William Fisher also describes a tamper resistant container which requires side squeezing in order to effect cap removal. In this case, the side of the container rather than the side of the cap requires compression. U.S. Pat. No. 4,759,455 to Woodrow S. Wilson describes a snap lid type of closure for child resistant containers which involves a deformable panel which must be pressed in at a specific location so as to force the panel inwardly to a slot formed through an engaged portion of the shoulder of the cap and, as a result, a slight separation occurs between the peripheral edge of the lid member and the shoulder so that the user, with the other hand while continuing to compress the panel, may engage the edge of the lid to open it. Likewise, U.S. Pat. No. 4,807,768 has a child resistant dispensing closure involving a snap lid wherein actuated slots in the lid create adequate deflection of the lid so that detents may be pushed inwardly to unlock and release the snap lid for subsequent opening. Notwithstanding the formidable prior art, it should be noted that none of the prior art teaches or suggests the present invention closure which involves a child resistant container and lid having a unique combination of elements which, together, create a system requiring the user to simultaneously squeeze and rotate a ring around the snap lid in order to effect opening. In this invention, the action not only releases an otherwise unopenable snap cap, but acts to lift up the snap cap without the user having to utilize the other hand to engage and pull the cap while squeezing, as is found in many of the prior art systems.

SUMMARY OF THE INVENTION

The present invention is directed to a child resistant container and lid which utilizes a semiflexible ring. The snap lid which is utilized in the present invention container is substantially set into the top of the container and this lid has one component of either an extended lift member or an indented lift guide. The ring has the other component of either the extended lift member or the indented lift guide. When the ring is rotated, the snap lid cannot be opened. The snap lid can only be opened when the ring is simultaneously squeezed and rotated. In an alternative embodiment, the two component lift system is utilized wherein both components extend outwardly rather than one extending outwardly and one indented. They have geometric configurations so that one first slides past the other and then, in their reverse motion, one lifts the other so as to lift up a lid during operation.

BRIEF DESCRIPTION OF THE DRAWINGS

The present invention will be more fully understood and appreciated when the description herein is taken in conjunction with the appended drawings, wherein.

DETAILED DESCRIPTION OF THE PRESENT INVENTION

As mentioned above, the present invention involves a child resistant container and lid. In general, it involves a container which has a snap lid set into it and has a ring about the container which operates in conjunction with the lid by complex movement so as to cause the opening of the lid. The present invention system involves the combination of squeezing and rotating the flexible ring over a specific area to effect the opening of the lid.

Figure 1:
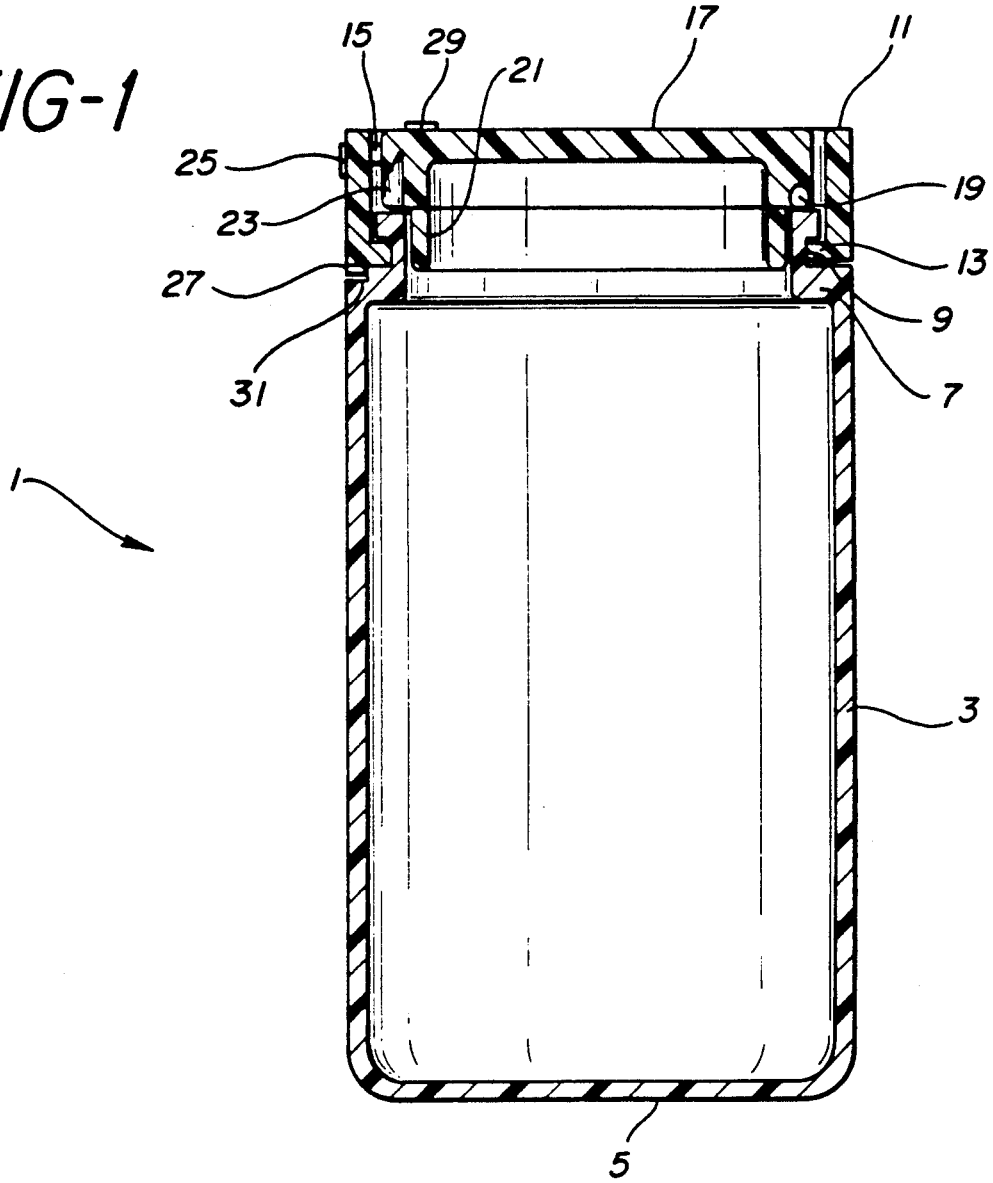
FIG. 1 shows a side cut view of a present invention container including a closed snap lid and a semi-flexible ring.

Referring now to FIG. 1 there is shown container 1 with container wall 3 and closed bottom 5. Open top 7 includes a ring track 9 and ring 11 has a lip or ring guide 13 which nests into ring track 9 so as to be rotatable therein. A first further recess which is a container stop 31 permits only partial rotation of ring 11 when the stop 31 operates in conjunction with ring stop 27. This side cut view of container 1 and ring 11 shows a typical container and, as may be envisioned, the shape of the container is not critical nor are the relative dimensions of the container. Thus, it has a substantially cylindrical, vertical wall but could be at the top or neck of a square container or other shape and it may be short and wide or thin and tall or, etc.

Also shown in FIG. 1 is extended lift member 15 which is like a button on the inside of ring 11, as well as an indicator 25 which actually shows the user where to press ring 11 during use. Snap lid 17 has a snap lid hinge 19 and a base 21 which is inserted into container 1.

Figure 2:
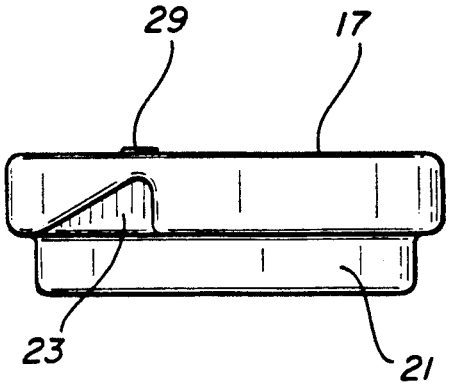
FIG. 2 shows the snap lid of FIG. 1 in an uncut version and slightly rotated so that a lift guide faces forward.

Referring to FIGS. 1 and 2 simultaneously, FIG. 2 shows an uncut slightly rotated version of snap lid 17 and base 21. As can be seen, indented lift guide 23 has a cut out type lift guide which, during normal rotation of ring 11, would not interact with extended lift member 15. However, if the user were to rotate ring 11 so that indicator 25 is aligned with snap lid indicator 29, and then the user squeezed the top of ring 11, extended lift member 15 would "insert" into indented lift guide 23. If the user continued to squeeze the ring 11 and rotate it in a clockwise fashion, extended lift member 15 would rise along the slope of indented lift guide 23 and automatically lift up snap lid 17.

Figure 3:
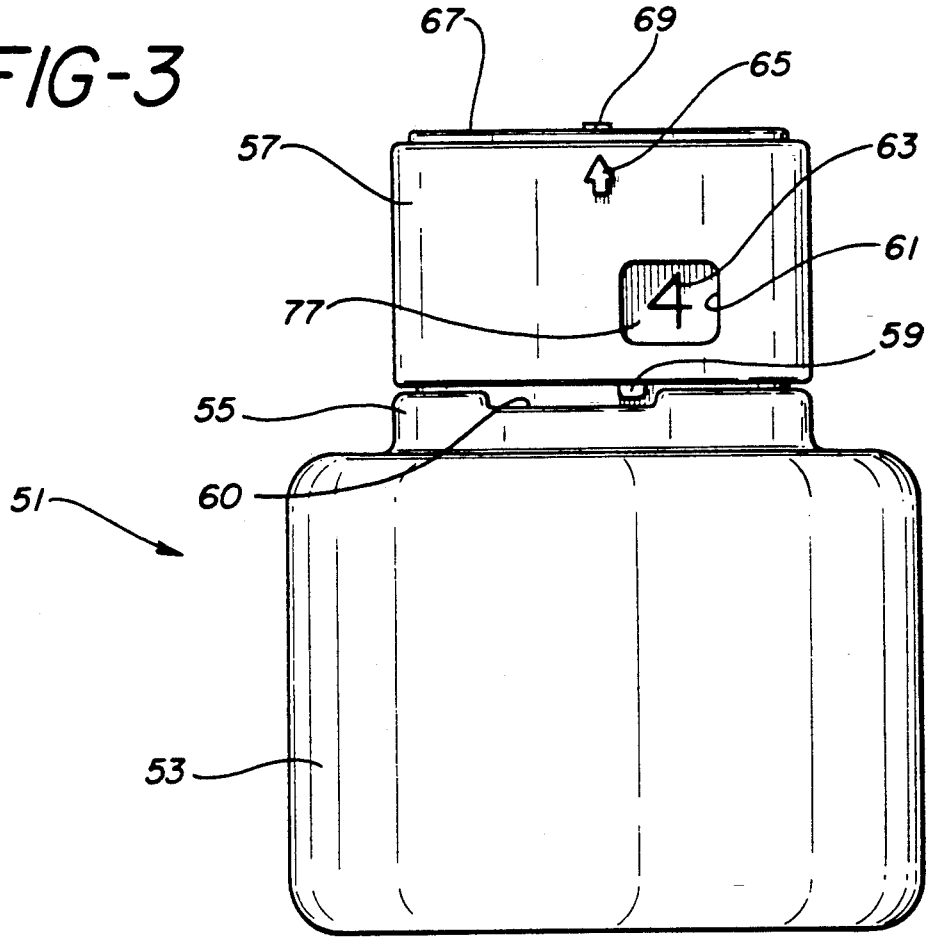
FIG. 3 shows a full side view of an alternative container and snap lid of the present invention including a day reminder.

Referring now to FIG. 3, there is shown a full view of an alternative container 51. Container 51 has a container wall 53 as shown and neck 55. Around neck 55 is ring 57 and ring stop 59 is located in container stop 60. Ring 57 includes a ring opening 61 for the purpose of displaying a day or other indicator such as display indicia 63. Ring 57 also includes ring indicator 65 and has a snap lid 67 with a snap lid indicator 69. Basically, this snap lid operates in the same fashion as that shown in FIG. 2 except that, each time the ring 57 is rotated through stop 60, indicia 63 will advance to a single integral higher so as to indicate the number of times or day of the week or the like for the user to be able to pace out the usage of medication.

Figure 4:
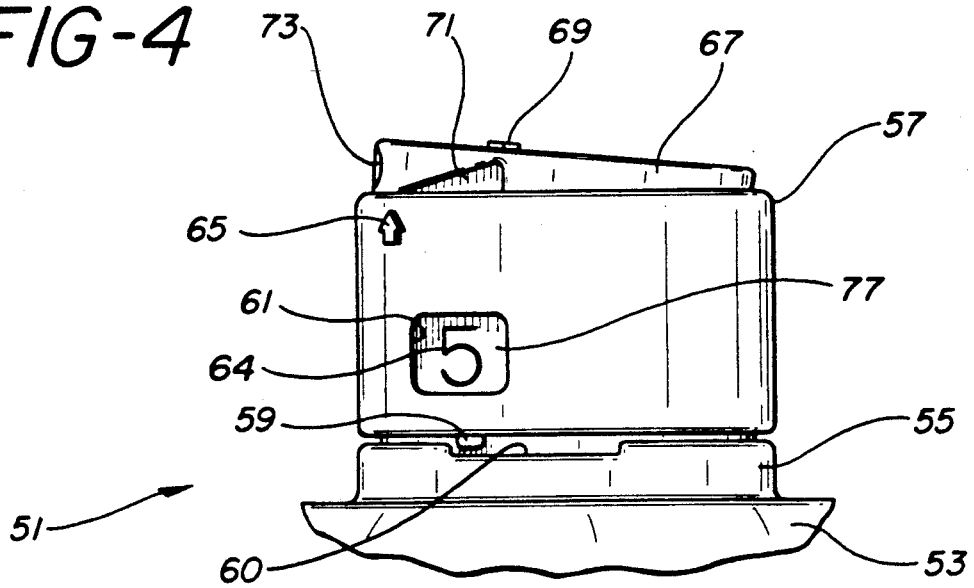
FIG. 4 shows a partial side view of the top section of the container of the present invention with the snap lid open and the day reminder advanced.

As can be seen in FIG. 4, which shows a partial view of the device of FIG. 3 but with ring 57 now rotated clockwise into the stop position, indented lift guide 71 is now exposed and snap lid 67 is open. Optional lift slot 73 is provided for the use of the thumb, but is typically unnecessary. As to FIG. 4, parts to those identical to those shown in FIG. 3 are identically numbered. It should be noted that display ring indicia 63 and 64, in this case, are printed numerals on ratcheted display ring 77 which is discussed in more detail below.

Figure 5:
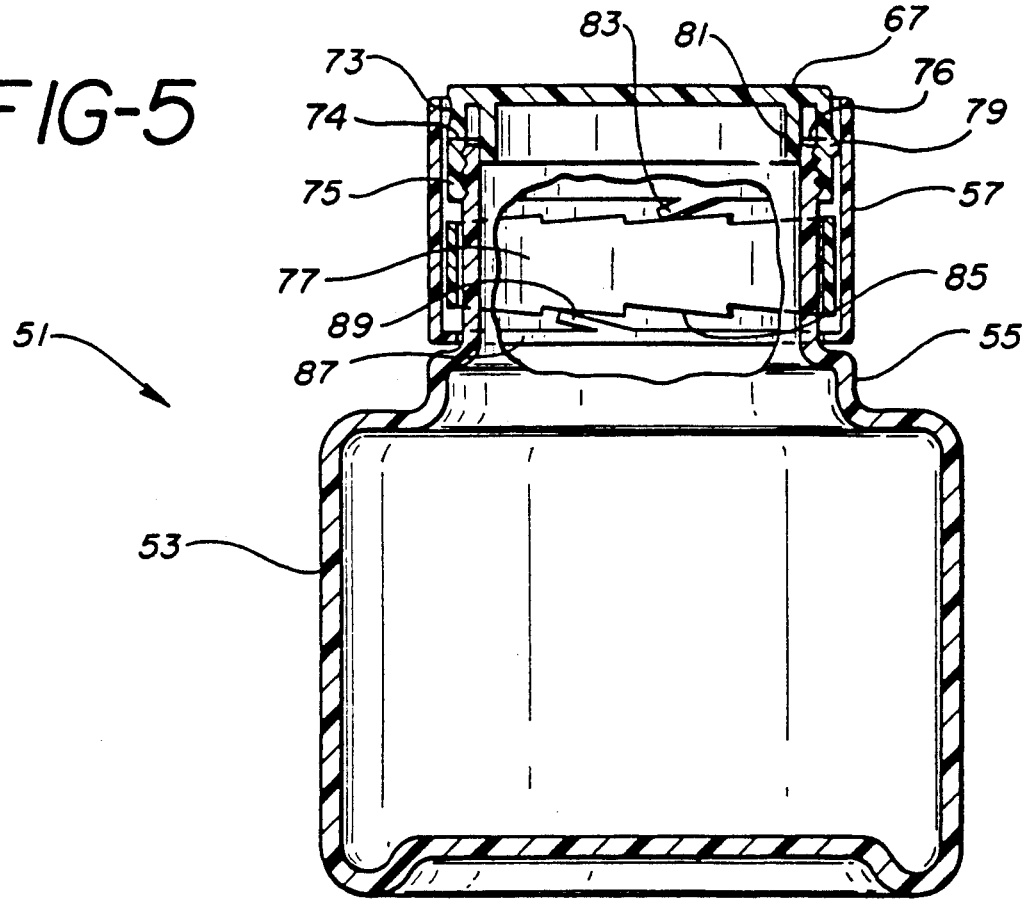
FIG. 5 shows a side cut view of the present invention container of FIG. 3 with a back portion of the container cut open to expose a display ring and pawl.

FIG. 5 shows a side cut view of a container 51 of FIGS. 3 and 4 as well as a cut out in the back of the container to expose the other aspects of the device. Container 51 in FIG. 5 has identical parts identically numbered. Snap lid 67 has a living hinge 79, as shown as well as an inside collar 81 which seals the container when the lid is closed and which lifts as part of the snap lid 67 when snap lid 67 is opened.

Figure 6:
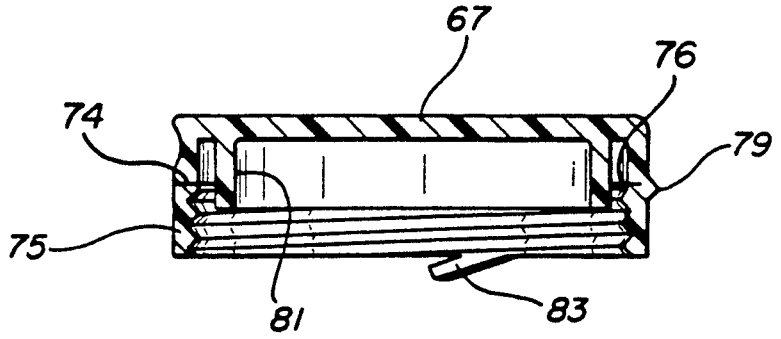
FIG. 6 shows a side cut view of the snap lid of the container shown in FIG. 5.
Figure 7:
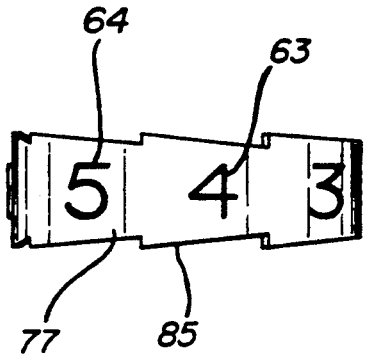
FIG. 7 shows a side view of a display ring from the present invention container of FIG. 5.

Referring now to both FIGS. 5 and 6, FIG. 6 shows a side cut view of snap lid 67 with identical parts identically numbered. Threads 75 are shown which are used to either removably or permanently thread the snap lid 67 onto container 51. Additionally, a snap lid pawl 83 is shown which operates in conjunction with ratcheted display ring 77. Referring also now to FIG. 7 as well as FIGS. 5 and 6, ratcheted display ring 77 is shown with ratchets typified by ratchet 85. Ring guide 87 has a ring guide pawl 89 as shown and when ring 57 is rotated through the length of stop 60, ratcheted display ring 77 is advanced one digit. When the ring 57 is rotated back to its original position pawl 83 prevents the ratcheted display ring 77 from rotating backward and maintains the position of advancing indicia. Lid 67 acts as a snap lid whereby it lifts and closes at line 74 (around the cap) and is hinged at living hinge 79, where it is only partially cut, as shown by line 76. While the double pawl mechanism for advancing and locking in the ratcheted display ring 77 is one way of achieving a combination child resistant system with a display indicator, other advance non-reversal mechanisms which have been used in the container field may be utilized in conjunction with the ring of the present invention. Additionally, it should be recognized that the ring track of FIG. 5 is not a definitive structure separate from the combination of elements, but is formed by the snap lid which holds in place ratcheted display ring 77, and the container neck 55 as shown. In other words, the snap lid 67 holds display ring 77 in place and the combination of display ring 77 and neck 55 keep ring 57 from moving up and down to any significant degree. Likewise, alternative designs could be utilized to maintain the ring in position without exceeding the scope of the present invention.

Figure 8:
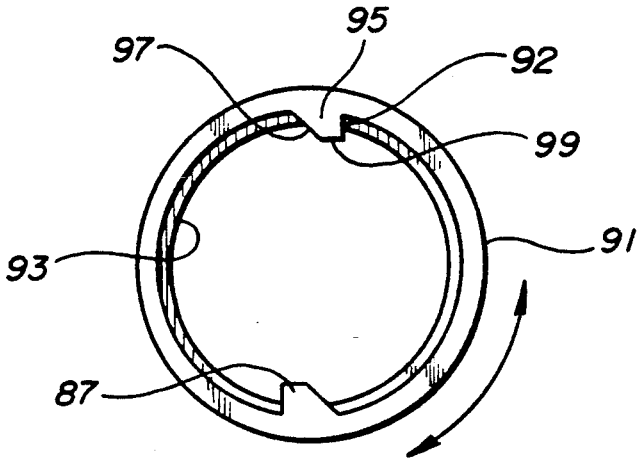
FIG. 8 shows a top view of a ring which could replace the ring shown with the container of FIG. 5.
Figure 9:
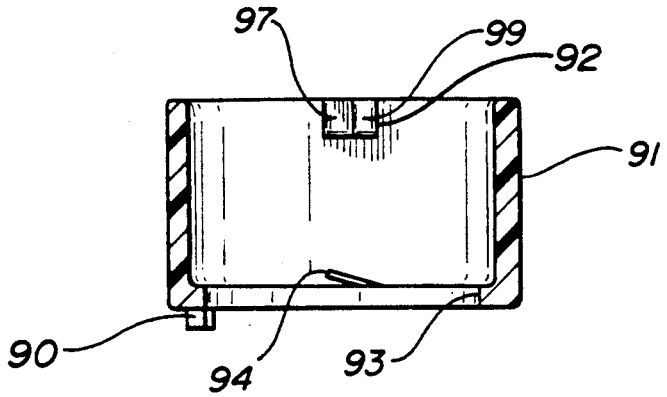
FIG. 9 shows a side cut view of that ring
Figure 10:
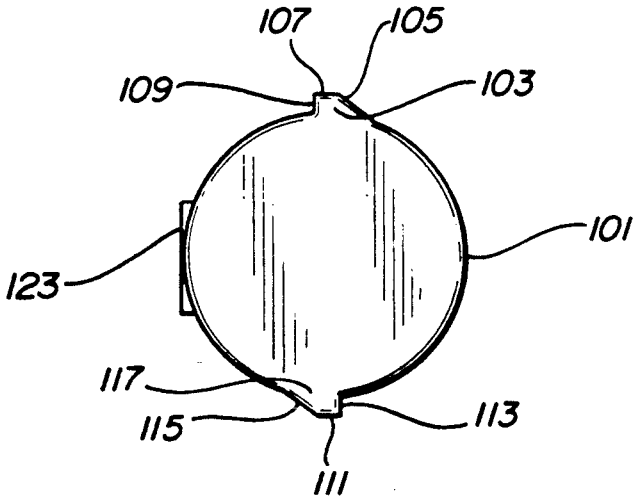
FIG. 10 shows a top view of an alternative lid to the snap lid shown in FIG. 5; and, FIG. 11 shows a side view of the snap lid shown in FIG. 10.
Figure 11:
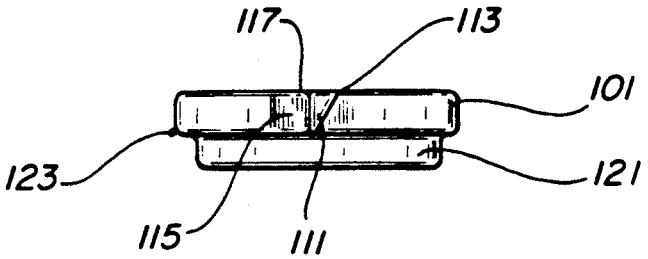

FIGS. 8 and 9 show an alternative ring and FIGS. 10 and 11 show an alternative snap cap for the type of device shown in FIG. 5. FIG. 8 shows a top of the ring and FIG. 9 shows a cut side view of ring 91 with ring stop 90. This ring 91 may be rotated only over a short distance consistent with the stop mechanism shown in FIGS. 3 and 4. Ring guide 93 is a ledge on the bottom portion of ring 91 and functions in a manner similar to the ring guide shown in FIG. 1. First extended lift member 95 has an extended first surface 92 which is located in the vertical plane and radially from the central axis. At approximate right angles thereto is second surface 99 which is also in the vertical plane. Third surface 97 is located in the vertical plane but is angled inwardly at an obtuse angle from second surface 99. These three surfaces and similar surfaces at extended lift member 87 operate in conjunction with extended lift members located on the snap cap. Thus, as shown in FIGS. 10 and 11, snap lid 101 has a second extended lift member (that is, second from the first extended lift member shown as first extended lift member 95). Second extended lift member 103 has an extended first surface 109 which is radial from the central axis but is at an upwardly acute plane from the horizontal and, therefore, is not a vertical surface. This meets with second surface 107 which is at right angles to the first surface and is in the vertical plane. Third surface 105 is likewise in the vertical plane and is angled inwardly from the second surface at an obtuse angle, as shown. Extended lift member 117 has identical components 111, 113 and 115 to components 107, 109, and 105. Snap lid inside collar 121 operates in a fashion similar to the inserted portion of snap lid 17 shown in FIG. 1 and hinge 123 functions in a manner similar to hinge 19 shown in FIG. 1.

As can be seen, when the snap lid of FIGS. 10 and 11 are inside a container collar such as container 51 of FIG. 5 or container 1 of FIG. 1, the extended lift members pass one another without contacting. However, as soon as ring 91 is squeezed, if it is rotated in a first direction it slides over the counter part extended lift members on the snap lid and, then when it is rotated in a reverse position, the (clockwise) "ramp" of the first extended surface which has the upwardly acute plane from the horizontal acts to lift up the lid when in contact with the vertical radial surface of each of the extended lift members of the ring.

Referring again to FIGS. 8 through 11, it should be noted that the device shown therein may be operated from a manner different from that stated above, without changing any of the detailed aspects of the drawings and with all of the parts identified and numbered as set forth above. More specifically, instead of the ring 91 needing to be squeezed when it is rotated in a first direction and sliding over the counterpart extended lift members on the snap lid and then reversing so that the ramping occurs as described above, the device may be utilized where squeezing only occurs on the return twist. Yet again, alternatively, it may be utilized without any squeezing whatsoever. In this particular embodiment, again, all of the parts would be identically identified and numbered as set forth in FIGS. 8 through 11 except that the ring 91 when rotated in a first direction would not slide over the counterpart extended lift member on the lid unless a certain force or user strength were applied. In other words, the interactions of the extended lift members on the ring and lid would be based on their relative sizes and contact with one another so that a resistance would occur which would require more force than a young child could apply. In this way, the user would merely rotate the ring in a first direction using substantial force to overcome the resistance of the extended lift members and then rotate the ring in the opposite direction to have the lift member ride under the counterpart lift member so as to cause ramping and opening of the lid.

Obviously, numerous modifications and variations of the present invention are possible in light of the above teachings.

What is claimed is:

1. A child resistant container and lid, comprising:

(a) a container having a substantially cylindrical, vertical wall, an open top and a closed bottom, a ring track formed on a wall of said container near the top of said container, said ring track adapted to receive and act as a guide for a ring, said ring track having first stop component;

(b) a snap lid hingeably attached to the top of said container and substantially located inside the top of said container with the top of said lid at or near the top of said container when said lid is closed, said lid having one component of an extended lift member and an indented lift guide, and being engageable with the other of said extended lift member and said indented lift guide; and, (c) a ring which is semi-flexible and is rotatably connected to said ring track, said ring having a second stop component which is located to be coincidental with said first stop component when said ring is rotated within said track, and to stop further rotation when said first stop and second stop contact one another, said ring further having the other component of said extended lift member and said indented lift guide, said ring being squeezable and rotatable such that simultaneous squeezing and rotating of said ring engages said extended lift member with said indented lift guide so as to unfasten and lift open said lid, and such that when said ring is not squeezed, said extended lift member and said indented lift guide are not engaged.

2. The container and lid of claim 1 wherein said first stop component is one of an extended post and a corresponding indentation and the second stop component is the other of these.

3. The container and lid of claim 1 wherein said top of said container is integrally formed with said vertical wall.

4. The container and lid of claim 1 wherein said lid is hingedly attached to said top with a living hinge.

5. The container and lid of claim 1 further including a counting indicator display which advances a display integrally with each opening rotation of said ring.

6. The container and lid of claim 5 wherein said counting indicator display is a separate, ratcheted display ring located within said semi-flexible ring, and said semi-flexible ring has an opening therein through which a display on said display ring may be shown.

7. The container and lid of claim 6 wherein said semi-flexible ring has at least one pawl located therein to engage ratchets of said display ring so as to advance said display ring when said semi-flexible ring is advanced.

* * * * *